United States Patent [19]

Hofmeester

[11] 4,301,606

[45] Nov. 24, 1981

[54] APPARATUS FOR EXCAVATING A TRENCH UNDERNEATH A PIPELINE INSTALLED ON THE SEA BOTTOM

[75] Inventor: Paul M. Hofmeester, Kristiansund, Norway

[73] Assignee: Netherlands Offshore Co., Delft, Netherlands

[21] Appl. No.: 60,173

[22] Filed: Jul. 24, 1979

[30] Foreign Application Priority Data

Jul. 31, 1978 [NL] Netherlands ..... 7808064

[51] Int. Cl.[3] ..... E02F 3/88; E02F 5/08

[52] U.S. Cl. ..... 37/66; 37/94; 405/163

[58] Field of Search ..... 37/66, 91, 94–97; 405/159–165

[56] References Cited

U.S. PATENT DOCUMENTS

| | | | |
|---|---|---|---|
| 3,722,224 | 3/1973 | Roy | 405/163 |
| 3,877,238 | 4/1975 | Chang et al. | 37/61 X |
| 4,037,422 | 7/1977 | DeBoer | 405/160 |
| 4,044,566 | 8/1977 | Biberg . | |
| 4,117,689 | 10/1978 | Martin | 405/163 |
| 4,149,326 | 4/1979 | Rosa et al. | 405/160 |

FOREIGN PATENT DOCUMENTS

| | | | |
|---|---|---|---|
| 6902780 | 5/1970 | Netherlands . | |
| 7406931 | 11/1975 | Netherlands | 37/66 |
| 156489 | 4/1962 | U.S.S.R. | 37/91 |
| 183675 | 8/1966 | U.S.S.R. | 37/91 |
| 293951 | 3/1971 | U.S.S.R. | 37/66 |
| 642439 | 1/1979 | U.S.S.R. | 37/94 |

*Primary Examiner*—Clifford D. Crowder

*Attorney, Agent, or Firm*—Scully, Scott, Murphy & Presser

[57] ABSTRACT

An apparatus for excavating a trench underneath a pipeline installed at the sea bottom, which apparatus is provided with rotating excavators, means for guiding the excavator relative to the pipeline, as well as means for advancing the excavator along the pipeline, whereby the excavators comprise at least two bucket wheels, 15, 16, 15′, 16′, disposed side-by-side on either side of the pipeline 9 parallel to the direction of advancement P, the main planes of said buckets enclosing an acute angle with each other and intersecting each other underneath the pipeline 9, which bucket wheels are disposed in said main planes, and being adjustable in height.

5 Claims, 10 Drawing Figures

Figure 1:
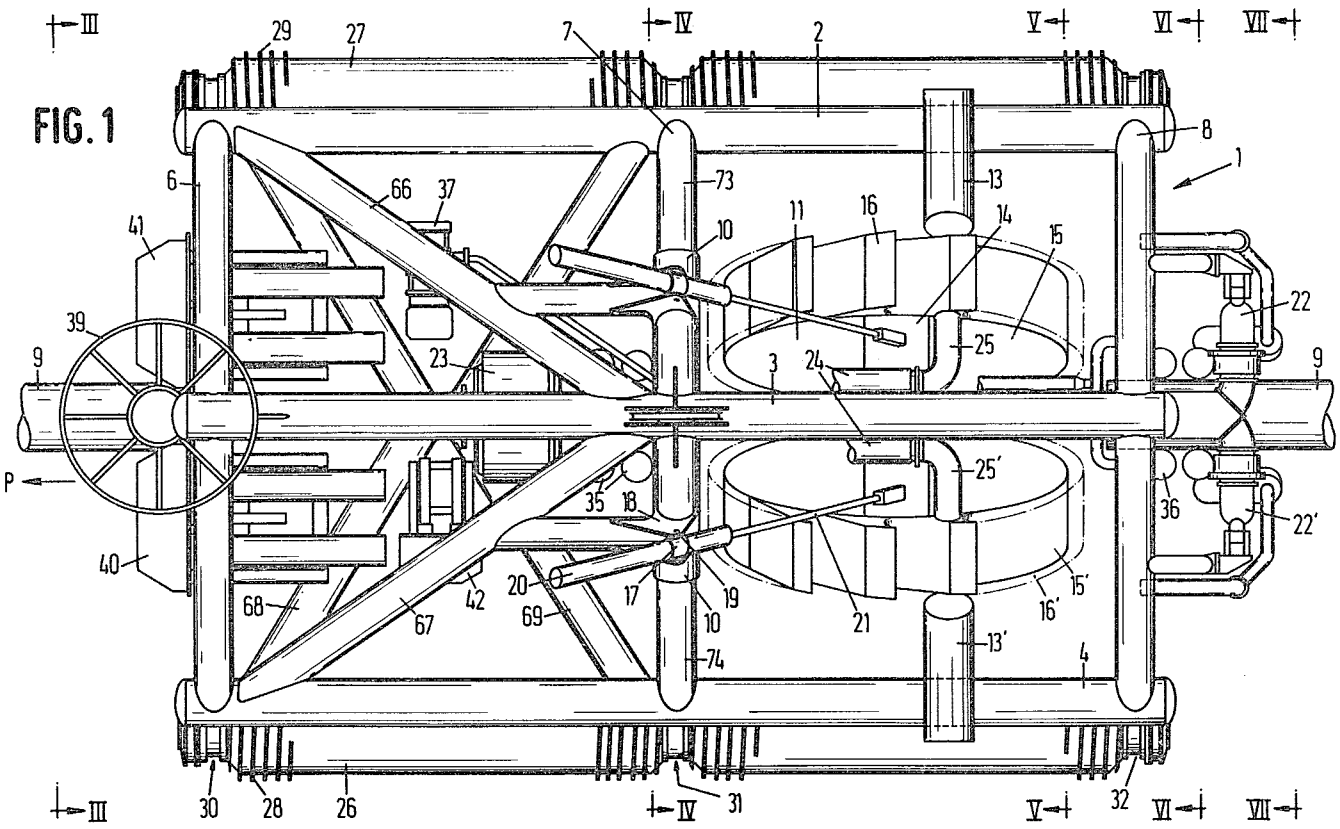

APPARATUS FOR EXCAVATING A TRENCH UNDERNEATH A PIPELINE INSTALLED ON THE SEA BOTTOM

The invention relates to the excavation of a trench underneath a pipeline situated on the sea bottom.

It is now conventional for transporting e.g. gas and oil under water to install a pipeline on the sea bottom. This pipeline should preferably not lie loose on the sea bottom but in a trench in order to minimize the chance of damage to the pipeline. Very many methods and apparatuses are known which are more or less suitable for installing such a trench and the subsequent lowering into this trench of the pipeline already laid on the sea bottom. For instance Dutch patent application No. 69, 02780 describes an apparatus which substantially comprises a plurality of spray nozzles applied slidably on the pipeline, to which pressurized water is supplied. These spray nozzles, at least when the bottom is hardly cohesive, are adapted to loosen the soil adjacent the pipeline. The loosened soil is then emulsified through supply of pressurized air while the resulting emulsion is drawn in by means of suction heads installed adjacent the pipeline. The advancement of said apparatus is effected by means of a towing cable which is attached to a working vessel, which vessel tows the apparatus across the pipeline.

In this manner a very broad trench is excavated that no longer silts up, it not being quite possible to apply said trench underneath the pipeline. Moreover said spray nozzles cannot be applied in soil having a high cohesion value. Squirting processes moreover are very ineffectve.

A similar principle is described in Dutch application No. 74, 14468, wherein likewise nozzles and suction pipes are employed. Also this apparatus is towed from a ship by means of a towing cable across the already installed pipeline on the sea bottom.

In Dutch application No. 75, 10086 there is described an apparatus for making trenches which is provided with its own propulsion system and which consequently is not towed from a ship across the pipeline. The apparatus is provided with a plurality of floating bodies for relieving the pipeline of the weight of the trencher. The trencher proper comprises a single cutter adapted to cut a trench beside the pipeline.

The employed floating bodies are partly filled with water and float on the sea level, which renders this apparatus exclusively suitable for operation at very quiet sea. Since the cutter trenches a trench adjacent the pipeline, the pipeline will have to be laterally moved into the trench, which cannot be effected with the trencher.

In Dutch application No. 76.01410 finally there is described an apparatus for excavating a trench underneath a pipeline installed on the sea bottom, which apparatus is provided with rotating excavating tools, as well as means for guiding the excavating tools relative to the pipeline and means for advancing the trencher along the pipeline. The excavating tools are each formed by a row of cutters applied around the pipe which are adapted to loosen the soil underneath and adjacent the pipeline, after which the thus loosened soil is sucked away. In principle this trencher is suitable for treating cohesive soil. When applying the trencher the lower parts of the row of cutters is taken away so that the trencher can be lowered onto and over the pipe.

Subsequently the lacking sector of the row of cutters is rotated in the proper position so that the row of cutters can fully embrace the pipe and can be rotated around the pipeline.

A drawback going with this prior art apparatus is the highly unfavourable form of the trench to be excavated. As a matter of fact for obtaining the required depth of about 2 m for a pipe of a diameter of 1 m, an enormous row of cutters has to be used having at least a diameter of 5 m. The trench then obtains the required depth, but is much too large for the object in mind, so that an unnecessary disturbance of the surroundings of the pipeline is produced. Moreover this prior art apparatus has an extremely intricate mechanism, since all kinds of mechanisms are required for positioning the non-circular row of cutters on the pipeline and subsequently to rotate the lacking segment in the proper position and enclosing same in the other sector of the row of cutters.

It is the object of the invention to provide an apparatus of the latter type, wherein a trench of the required depth can be excavated with a minimal disturbance of the surroundings on either side of the pipeline and a high capacity yield, with avoidance of complicated mechanical constructions as necessary for this prior art apparatus.

The apparatus according to the invention is characterized in that the excavating tools comprise at least two adjacently disposed bucket wheels positioned on either side of the pipeline parallel to the direction of movement, the main faces of which enclose an acute angle with each other and intersecting each other underneath the pipeline, which bucket wheels in said main faces are positioned adjustable in height.

It has been found that bucket wheels are highly suitable both in less cohesive soil with e.g. a cohesion value to 1 kg per $cm^2$, as well as in soil having a cohesion value of about 3 kg per $cm^2$. Through the inclined position of the bucket wheels a sharply marked trench can be excavated directly underneath the pipeline without the trench obtaining an excessive width at the top. Through application of bucket wheels the soil is not loosened and subsequently sucked up by dredging pumps, but the soil is scooped up and entrained, after which it can be deposited adjacent the excavated trench. The bucket wheels are disposed side-by-side parallel to the direction of movement, so that a trench of substantially trapezoidal cross-section is applied underneath the pipeline. The trench should under certain conditions be excavated with some over-depth since between the adjacently disposed bucket wheels there remains a ridge of soil of triangular cross-section which cannot be scooped by the bucket wheels from the trench. This soil ridge will usually collapse behind the trencher and be distributed over the trench bottom. By means of a dredge pump it is possible to draw in the quantity of bottom material which originally belonged to said soil ridge, in which case excavation will be possible at the eventually required depth of e.g. 2 m. It is also possible to distribute said soil ridge over the bottom of the trench, possibly by means of nozzles. In this case excavation should take place with some overdepth.

The excavation with overdepth might be omitted by the tandem position of the bucket wheels in the frame. However this appears to provide a substantial turning moment of the excavating tool about a vertical axis, which moment can only be taken up by articulation means engaging on the pipeline. The load on the pipe however thereby increases to an undesirable level.

In the apparatus as described in Dutch patent application No. 76,01410 the excavating apparatus rests on the pipeline and is guided by said pipeline, whereby the movement of the apparatus is produced by hydraulic cylinders which are adapted to reduce or increase the distance between the two ends of the trencher and thus it is possible to advance the trencher step-wise across the pipeline. In principle consequently the pipeline carries the weight of the trencher and since this is undesirable, a trimming tank should be present in order to reduce the vertical load of the pipeline.

In a preferred embodiment of the trencher according to the invention, the pipeline need only to perform the guiding function and no longer the carrying function, as is the case in the prior art apparatus. To this end the bucket wheels are disposed on a self-supporting frame resting on the sea bottom adjacent the pipeline, which frame is provided likewise with means guiding said frame exclusively in lateral direction relative to the pipeline.

The bucket wheels of the apparatus according to the invention preferably comprise a rotary outer wheel mounted on a stationary hub or stator, which outer wheel is provided with a plurality of excavated buckets with cutting edges extending substantially in the axis direction of the bucket wheel, while the oppositely disposed cutting edges of the excavated buckets are open. In this manner a water jet may be utilized for emptying the excavator buckets open on either side, which water jet naturally is directed parallel to the excavator buckets from a point at the interior of the bucket wheel lying at the side of the movement path of the excavator buckets.

The bucket wheels disposed on either side of the pipeline should be adapted for being brought in and out of the trenching position and to this effect each stator is mounted on a wheel arm, which is pivotally connected to the frame at the side directed away from the stator axis, while lifting means are present engaging on the one end on the frame and on the other end on said wheel arm. When positioning the trencher over the pipeline then installed on the sea bottom, the bucket wheels are in the lifted position and once the frame is resting on the sea bottom, the bucket wheels can be brought in the trenching position via said lifting means.

The stator for each bucket wheel comprises preferably a closed oil-filled and pressure-compensated cylindrical box accommodating the drive for the rotary outer wheel mounted on said box.

Preferably the advancement means substantially comprise two independently driven cylinders disposed on either side of and parallel to the pipeline at the bottom of the frame, which cylinders are provided at the outer circumference with spirally disposed fins, whereby the winding direction for the one cylinder is opposite to that of the other cylinder, at identical pitch angle.

When both cylinders rotate in opposite direction, there is obtained on the frame a driving force directed forwardly along the pipeline, whereby no or substantially no radial forces are exerted on the pipeline, in that the oppositely directed radial forces eliminate each other. By imparting the same direction of rotation to both cylinders, the frame may be displaced in transverse direction relative to the pipeline. Adjustment is possible by stopping a drive roller.

Since the frame rests on the sea bottom and consequently not on the pipeline itself, guiding means should be present adapted to guide the trencher in a plane substantially parallel to the sea bottom. Said guiding means preferably comprise at least two pairs of rollers disposed in spaced apart relationship in the frame, each pair consisting of two rollers substantially perpendicular to the pipeline and disposed on either side of the pipeline, which rollers are pivotal relative to the pipeline between a position wherein the guide rollers abut the pipeline and a position in which they have been swivelled against the frame. By measuring the forces exerted on said guide rollers as to their direction and magnitude, information may be obtained regarding the position of the trencher relative to the pipeline, which information may be used for adjusting the trencher.

Figure 2:
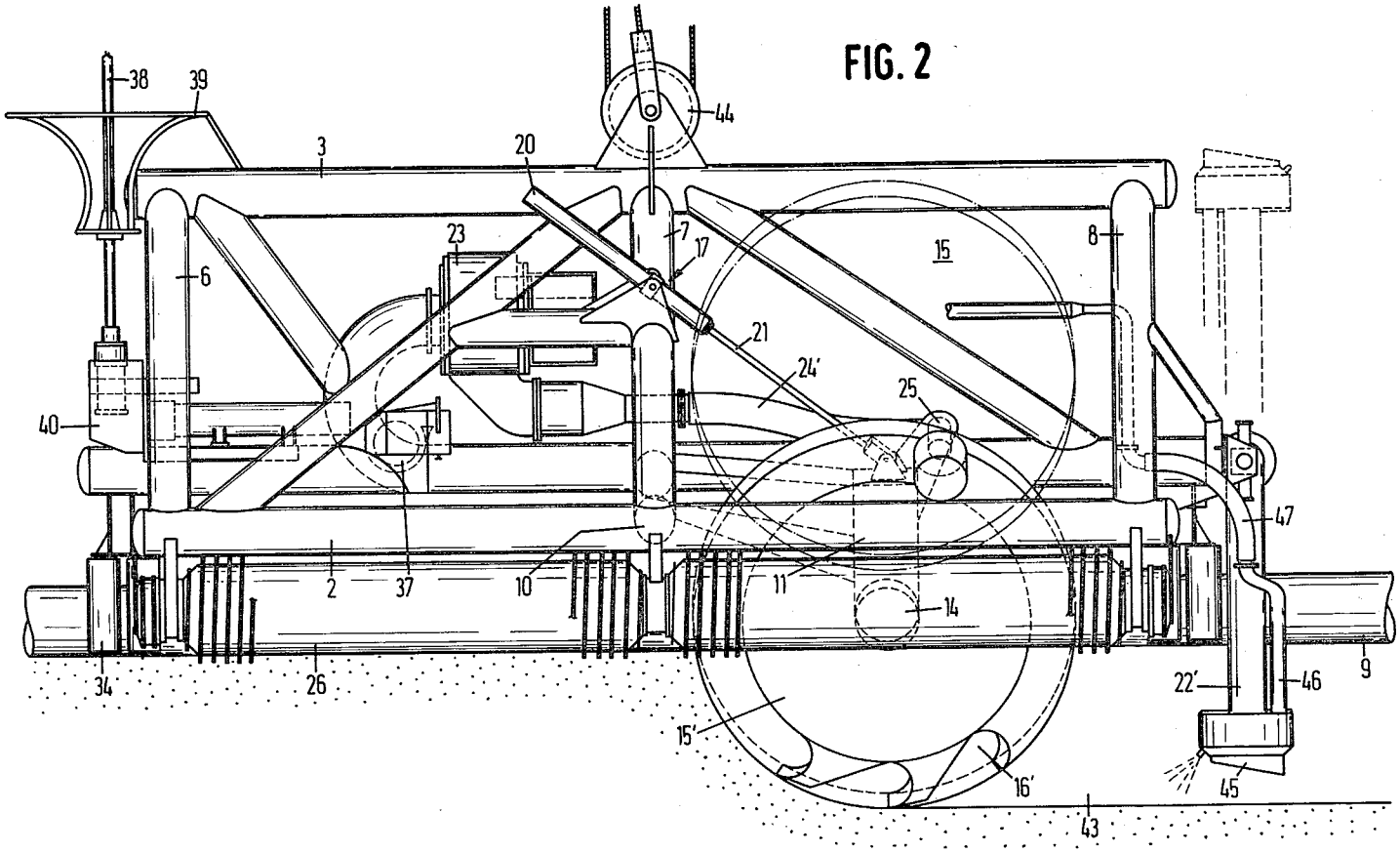
Figure 3:
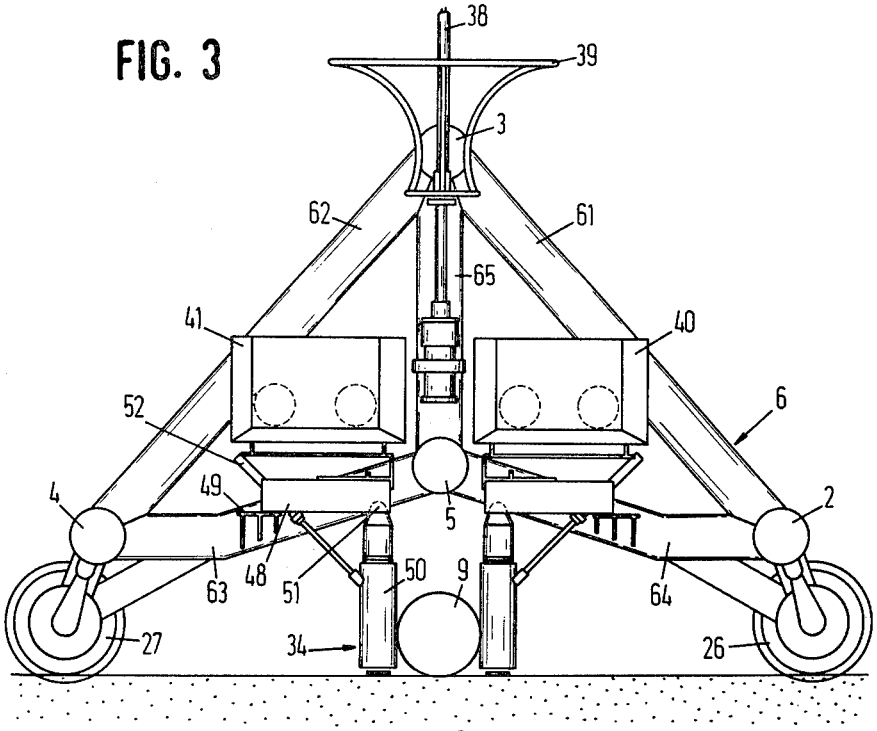
Figure 4:
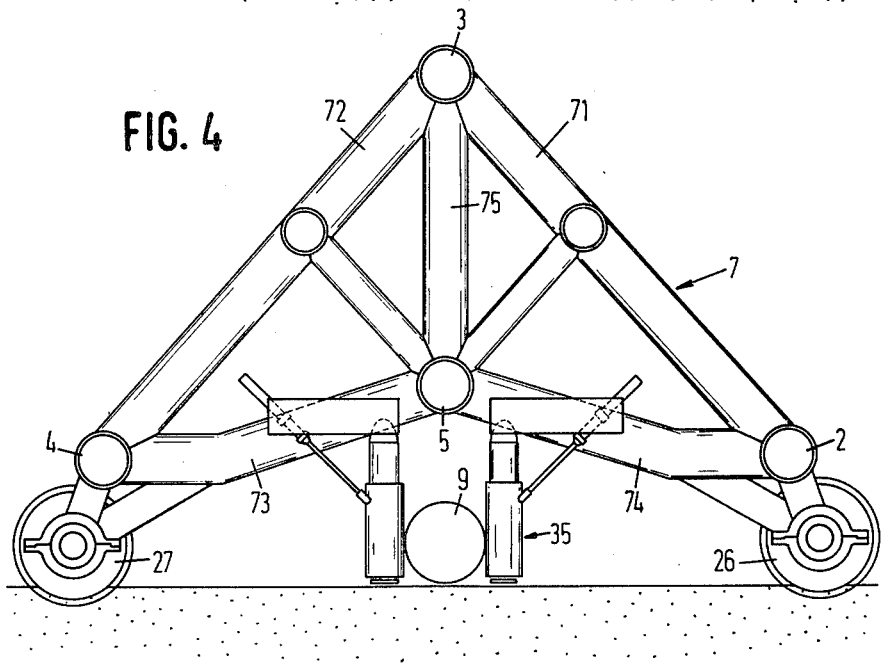
Figure 5A:
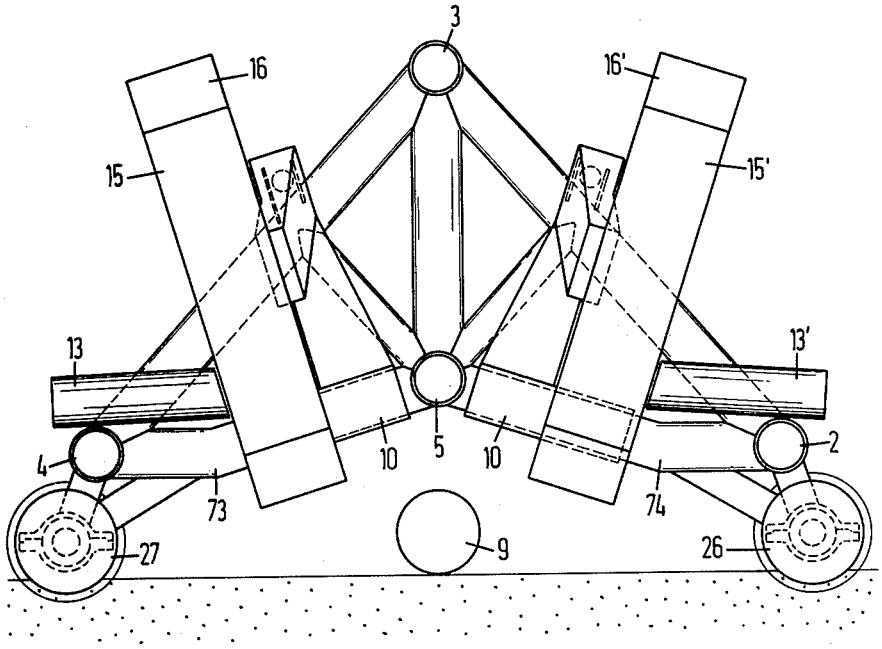
Figure 5B:
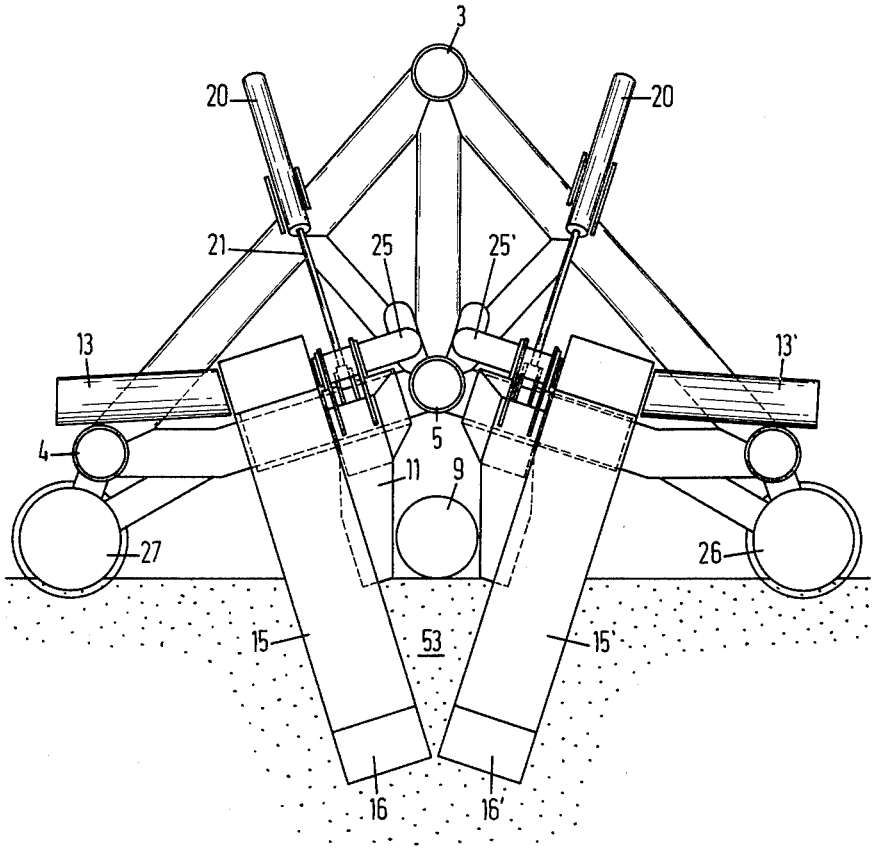
Figure 6:
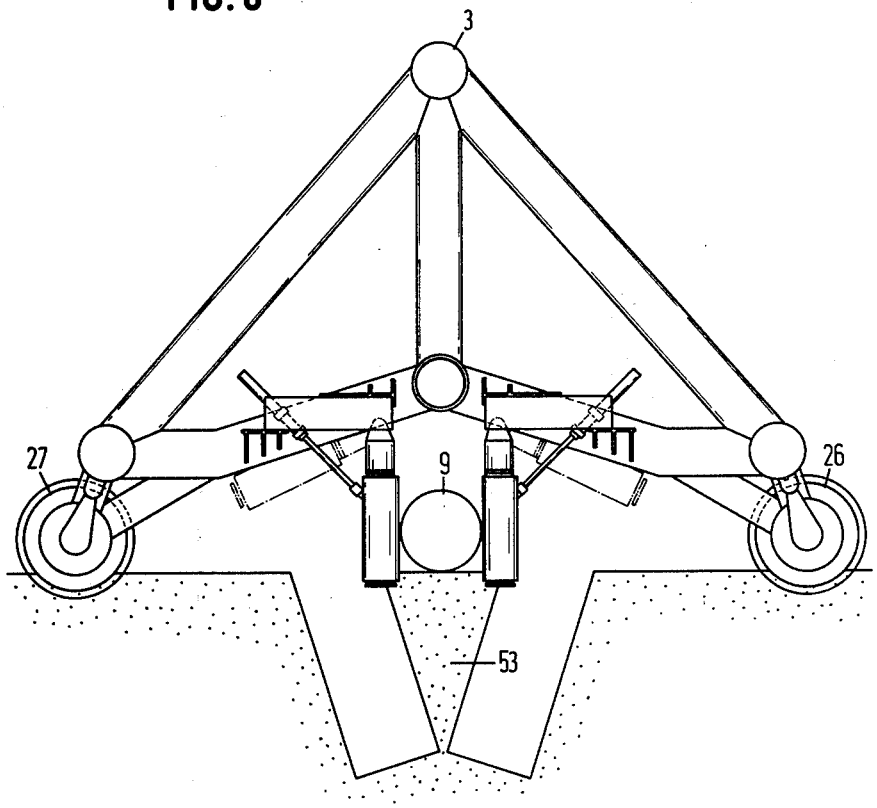
Figure 7:
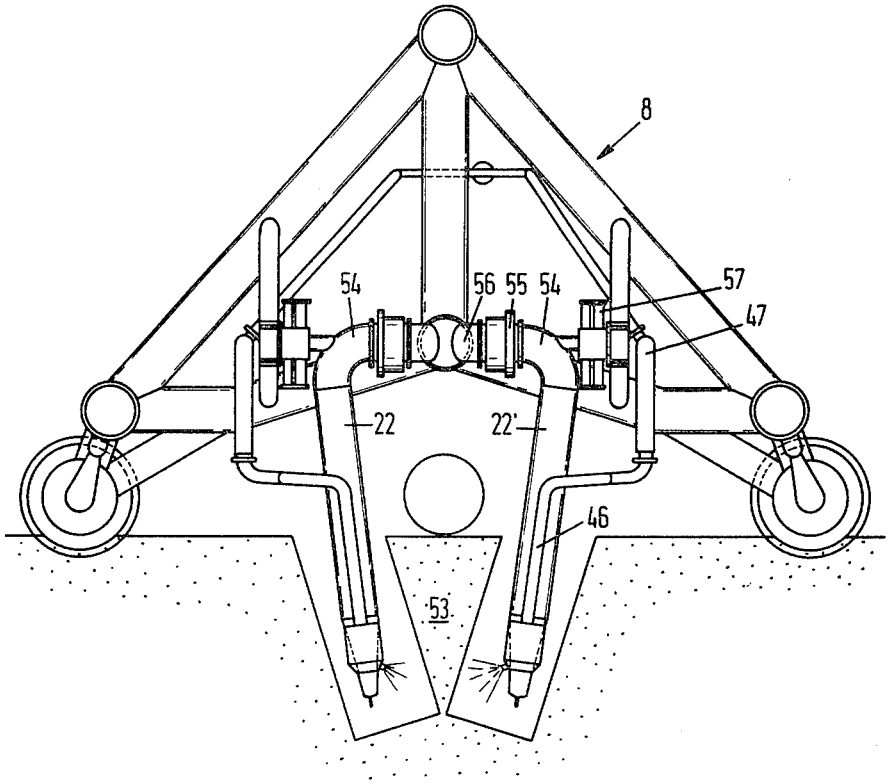

One embodiment of the trencher according to the invention will now be explained, by way of example, with reference to the accompanying drawings, wherein:

FIG. 1 is a top view of the trencher;

FIG. 2 a side view of the apparatus with omission of the sidewall of the trench to be excavated;

FIG. 3 a view on the line III—III of FIG. 1;

FIG. 4 a diagrammatic cross-section on the line IV—IV in FIG. 1, with omission of a number of parts;

FIGS. 5*a*–5*b* a view, partly in cross-section, on the line V—V of FIG. 1, with lifted, respectively lowered bucket wheels;

FIG. 6 a view, partly in cross-section, on the line VI—VI of FIG. 1;

FIG. 7 a view on the line VIII—VIII of FIG. 1 and

Figure 8:
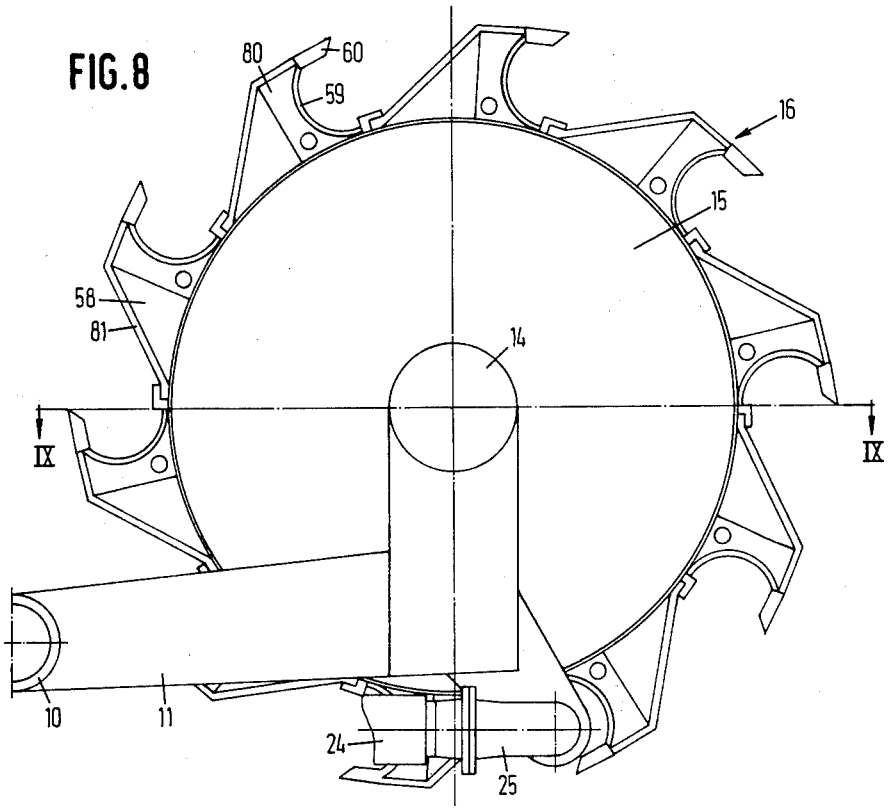
Figure 9:
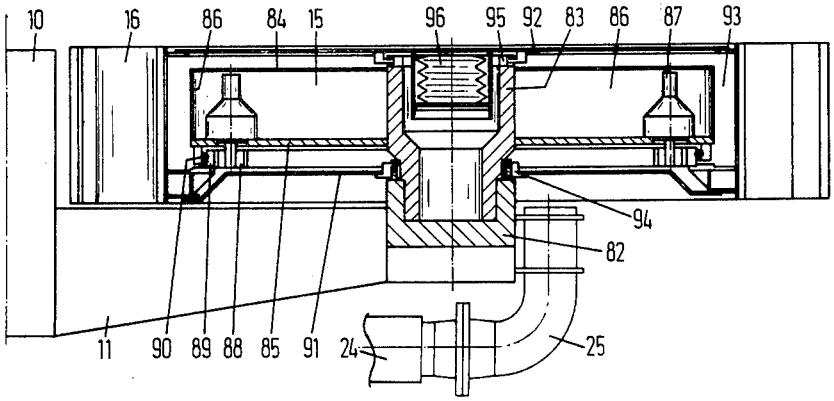

FIG. 8 a view of a bucket wheel;

FIG. 9 a cross-section through a bucket wheel on the line IX—IX of FIG. 8.

In FIG. 1 is indicated by reference numeral 1 the main frame of the trencher. This main frame substantially comprises four tubes 2, 3, 4, 5 extending in longitudinal direction of the trencher, which longitudinal tubes are interconnected at least in three planes, respectively the front plane 6, the centre plane 7 and the rear plane 8 by means of suitable supporting tubes. The longitudinal tubes 2, 3 and 4 lie on the angular points of an isosceles triangle. The tube 5 lies underneath the tube 3 and between the tubes 2 and 4. The interconnection of said tubes 2–5 comprises the tubes 61–65 (see FIG. 3). In the planes 7 and 8 identical connection tubes are applied. Besides connection tubes applied in planes 6–8 still other tube sections may be applied for reinforcing the frame 1 such as tubes 66, 67, 68 and 79 in FIG. 1. The planes 6 and 7 and 7 and 8 have an interspace the size of which naturally depends on the size of the trencher. Said distance may for instance be 8.5 m, at a total length of the trencher of about 20 m. At the left-hand and right-hand side of the trencher in FIG. 1 is indicated the tube 9 to be lowered, while arrow P indicates the direction of movement of the trencher.

In situ of the centre plane 7, two bushes 10 designed as plain bearings are applied on the supporting tubes 73, 74, on each of which there is secured a wheel arm 11. On the shaft 14 of the wheel arm 11 is disposed the stator 15 which at the exterior carries the bucket wheel 16 proper, which is adapted to rotate about the stator 15 and which is driven from stator 15. In order to move the bucket wheels 15, 16 upwards and downwards, there are provided height adjustment means 17. Said adjustment means comprise a seating 18 wherein a shaft 19 is rotatably mounted. The shaft 19 carries the cylinder portion 20 of a hydraulic piston-cylinder combination 21, 20, whereby the end of the piston rod 21 is secured to the wheel arm 11 adjacent the shaft 14 of the stator 15. By forcing out the piston rod 21 from the cylinder 20, the bucket wheel 15, 16 in the main plane of the bucket wheel can be moved downwards, while the bucket wheel may be lifted by pulling the piston rod 21 in the cylinder 20. Both bucket wheels 15, 16 are provided with identical height adjustment means.

At the back of the trencher there are mounted two suction lines 22, 22', which are connected via the longitudinally extending frame tube 5 to a dredge pump 23. From the dredge pump 23 extend two delivery pipes 24, 24', the ends 25, 25' of which are so positioned that each end comes to lie opposite the path of movement of the associated bucket wheel 16. By means of the dredge pump 23 two water jets may be produced that squirt the contents of the buckets of the bucket wheel 16 from the inside of the trencher in outward direction, so that the excavated soil lifted by the buckets is deposited aside the trencher, consequently also aside the excavated trench. Opposite the ends 25, 25' of the delivery pipes 24, 24' there are provided at the other side of the bucket wheels 16 discharge tubes 13, 13' for laterally discharging the excavated bottom material.

At the bottom of the frame are secured the cylindrical rollers 26, 27 which are mounted respectively in the bearing 30 in situ of the front plane 6, the bearing 31 adjacent the centre plane 7 and the bearing 32 adjacent the rear plane 8. On the cylinders 26, 27 there are peripherally disposed spirally formed wound fins 28, 29, e.g. by welding, whereby the winding direction for the fins 28 is opposite to the winding direction of the fins 29, at identical pitch angle. The cylinders 26, 27 are each driven by two hydraulic motors which are disposed at the front and back side of each cylinder 26, 27 and which are driven from a hydraulic unit 40 mounted at the front of the trencher. When the cylinders 26, 27 rotate in opposite direction, the trencher will be moved in the direction of the arrow P. The hydraulic drive for cylinders 26, 27 may operate in two rotation directions, so that the cylinders 26, 27 may also be driven in the same direction, whereby the trencher may be displaced laterally. In case only one cylinder is driven, e.g. 26 and when the other is stopped, the trencher may follow a bend in the pipeline. Naturally the course of the pipeline 9 is to be recorded in some way or other in order to direct the trencher in the required direction by means of the finned cylinders 26, 27. To this end there are provided guide means 34, respectively 35 and 36 in the front plane 6, the centre plane 7 and the rear plane 8, which will be described in the following.

On the frame 1 there is furthermore mounted a second hydraulic unit 41 provided with two hydraulic pumps, each suitable for driving a bucket wheel 15, 16 respectively 15', 16'. The hydraulic auxiliary unit 42 serves for controlling the height adjustment means 17–21 of the bucket wheels. A high pressure pump 37 serves for providing water jets at high pressure to the back of the trencher, as will be explained in the following.

In FIG. 2 43 indicates the trench excavated by the bucket wheels 16, 16'. The pipe 9 sinks in said trench 43 through gravity.

In FIG. 2 39 indicates a protection device for the electric cable 38, via which cable the trencher may be supplied with power. For lowering the trencher there is positioned a rope sheave 44 on the top of the frame 1.

It clearly appears from FIG. 2 how the height adjustment means 17–21 for each bucket wheel are disposed in the frame 1. The piston rod 21 is connected to the wheel arm 11, above the stator shaft 14. When operating the hydraulic cylinder 20, the wheel arm 11 may rotate about the bush 10 designed as plain bearing. On the wheel arm 11 is likewise supported the end 25' of the delivery pipe 24', which delivery pipe 24' is designed as flexible tube. When adjusting the height of the bucket wheels 15, 16 the end 25 continues to occupy in this manner the proper position opposite the bucket wheel 16 proper, independently of the adjusted excavation depth.

Besides for supplying the water jets by means of which the excavator buckets are emptied, the dredge pump 23 likewise serves for drawing in from the excavator trench bottom material possibly falling back or remaining in said trench. To this effect there is mounted a suction head 45 at the bottom of each suction pipe 22, 22'. Said suction pipe 22' may be swivelled in a vertical plane as shown by dotted lines in FIG. 2. On the suction head 45 there is likewise mounted a delivery pipe 46 which is connected to the high pressure pump 37. Said delivery pipe 46 serves for possibly fragmenting and/or distributing over the trench bottom the bottom ridge remaining between the bucket wheels (see FIG. 5*b*). The delivery pipe 46 is provided with a flexible portion 47, so that also this pipe can follow the swivelling movement of the suction pipe 22'.

In FIG. 3 is indicated a front view of the trencher from which the mutual pipe connections between the frame tubes 2–5 appear, as well as the construction of the guide means 34. The guide means 34 comprise two slides 48 disposed on either side of the tube 9 which are laterally displaceable in a direction perpendicular to the tube 9 and mounted in adapted guides 49. By moving the slides 48 the guide means may be adapted to the diameter of the pipe 9 to be lowered and be secured in the proper position. On each slide 48 a roller 50 is pivotally mounted about a shaft 51, possibly a pair of rollers (see FIG. 1). The roller 50 is maintained in the vertical position by a hydraulic piston-cylinder combination 52. The hydraulic cylinder 52 is not only suitable for swivelling the roller 50 during the positioning of the trencher across the tube 9, but likewise designed as dynamometer transmitting a signal that is proportional to the forces exerted on the roller 50 by the pipe 9. The resulting signal is indicative of the position of the trencher relative to the pipe 9. In the centre plane 7 and the rear plane 8 (see FIG. 4 and FIG. 6) similar guide means are disposed. The resulting signals may be indicative of the manner in which the cylinders 26, 27 have to be driven for adjusting, if necessary, the trencher.

FIG. 4 is a cross-section of the trencher according to FIG. 3. Besides the supporting tube sections 61–65 indicated in FIG. 3 for the plane 6, the centre plane 7 comprises two additional tube supports between the longitudinal tube 5 and the supporting tubes 71, respectively 72.

The construction of the guide means 35 corresponds to that of the means 34 (FIG. 3).

In FIGS. 5*a*–5*b* are shown the bucket wheels 15, 16 respectively 15', 16' in the lifted position, casu quo in the lowered or excavating position. FIG. 5*b* shows that the main plane of each bucket wheel is at an angle of approximately 20° to the vertical plane through the pipe 9. The bucket wheels, at least the sides thereof facing towards the pipe, are at a short interspace from said pipe. The excavation depth is limited in that the two bucket wheels may not touch each other naturally underneath the pipe. The maximal excavation depth should be larger than the required trench depth, since during the excavation of a trench between the bucket wheels a soil ridge 53 of substantially triangular cross-section remains in the trench. This soil ridge 53 will usually collapse or tilt, if necessary under influence of the high pressure water jets, originating from the nozzles/suction heads 45 (FIG. 2).

FIG. 6 shows the form of the excavated trench in case of non-collapsed or tilted soil ridge 53. In the rear view (FIG. 7) is illustrated the squirting of said soil ridge. FIG. 7 furthermore indicates that the two suction pipes 22, 22' are connected via the bends 54 to the rotary discs 55 enabling a swivelling in a substantially vertical plane of the suction pipes 22, 22'. Via the bends 56 the suction pipes 22, 22' are connected to the tube 5 extending longitudinally of the frame 1 and subsequently to the dredge pump 23 (FIG. 2). The swivelling of the suction pipes is effected by means of the rotary cylinders 57 which are connected both to the rear plane 8 of the frame and to the bends 55. During the swivelling of the tubes 22, 22' naturally the interconnected high pressure lines 46 are entrained, which is possible by the flexible line 47.

FIGS. 8–9 show the bucket wheel 15, 16, substantially comprising a stator 15 and an outer wheel 16 rotatable about said stator. Said outer wheel comprises 10 buckets 58 mainly consisting of a substantially semi-circular curved plate 59 provided with a cutting edge 60. The circular plate 59 is supported at the back by ridges 80 and the inclined plate 81, which are both connected to the inner circumference of the outer wheel 16, e.g. by welding.

The stator 15 is fixedly connected to the wheel arm 11. On said wheel arm 11 there is likewise mounted the pipe bend 25, so that the opening thereof, irrespective of the position of the outer wheel 16, is always flush with the buckets 58 passing said opening. On the wheel arm 11 there is mounted a hub 82 which is affixed to the hollow central shaft 83 of the stator 15. On said central shaft 83 there are welded two annular discs 84, 85, which discs are again interconnected by the cylindrical plate 86. Plates 84, 85 and 86 together with the hollow shaft 83 form a completely closed space 86 which is filled with oil. Said space is an open communication with the interior of the hollow shaft 83. Inside said closed space 86, evenly distributed over the circumference, e.g. 5 or 6 hydromotors 87 are mounted, two of which being shown in FIG. 9. The pressure lines for driving these motors 87 run via wheel arm 11, the hollow shaft 83 and the space 86 to the hydromotors 87. Each of the motors 87 drives a pinion 88 being in engagement with a gear 89 which is integral with the rotor or the bucket wheel 16. Said gear 89 likewise forms the inner ring of a ball bearing 90, the outer ring of which is again connected to the stator 15. The rotor 16 comprises substantially the annular plate 91 whereon the gear 89 is mounted, the circular plate 92 and the ring construction 93 interconnecting said plates 91, 92 peripherally, on which ring construction are mounted the buckets 58. The rotor plate 91 is provided at 94 with a sliding sealing relative to the hollow shaft 83.

By 96 is shown a pressure and temperature compensation device, substantially comprising a bellows connected to the rotor plate 92 disposed in the interior of the hollow shaft 83. The interior of said bellows is in open communication via an opening in the plate 92 to the sea water and on the exterior of the bellows 96 is acting the pressure of the oil-filled space 86. As a result of the thus obtained pressure equilibrium, no sea water will leak inwardly nor oil outwardly from the stator via the sealing 94. The bellows 96 ensures likewise the required pressure compensation at increasing oil temperature.

The rotor 16 is sufficiently rigid for preventing deformation and consequential seizure. The rotor plate 92 is enclosed in axial direction by means of the ring 95 having L-shaped cross-section, whereby one edge of the ring 95 engages in a slot provided in the hollow shaft 83.

I claim:

1. Apparatus for excavating a trench underneath a pipeline installed on the sea bottom, comprising:

a. a self supporting frame (1) resting on the bottom adjacent to the pipeline (9);

b. advancement means (26–29) supporting said frame and engaging the sea bottom;

c. guiding means (34, 35, 36) supported on said frame for guiding said frame exclusively in a lateral direction relative to the pipeline; and d. two rotating bucket wheels (15, 15',16, 16') disposed side by side on either side of the pipeline (9) parallel to the direction of advancement (p), the main planes of said bucket wheels enclosing an acute angle with each other and intersecting each other underneath the pipeline, said bucket wheels being adjustable in height, said bucket wheels comprise an outer wheel (16) rotatably mounted on a stationary hub or stator (15), said wheel is further provided with a plurality of excavator buckets (58) having cutting edges (60) extending substantially in axial direction of the bucket wheel, the oppositely disposed sides of the excavator buckets are open, and each stator (15) being mounted on one end of a wheel arm (11) the opposite end thereof being pivotally connected to the frame, lifting means (17) are provided which on the one end engage on the frame and on the other end on said wheel arm (11), in order to bring the bucket wheels 15, 16 in the lowered or excavating position or the lifted position.

2. An apparatus according to claim 1 having each stator 15 comprising a closed, oil-filled cylindrical box having a means to regulate the pressure therein, said box accommodating the drive for the rotary outer wheel 16 mounted on said box, and the outer wheel 16 further provided at the outer circumference of the stator shaft 83 with a sealing 94.

3. An apparatus according to claims 1 or 2, said apparatus further comprising guide means 34, 35, 36 each comprising at least one pair of rollers 50 spaced apart in the frame 1 on either side of the pipeline 9, which rollers are substantially perpendicular to the pipeline and being pivotable relative to the pipeline 9 between a position wherein the guide rollers adjoin the pipeline and a position wherein these are swivelled in the direction of the frame.

4. Apparatus for excavating a trench underneath a pipeline installed on the sea bottom, comprising:

a. a self supporting frame (1) resting on the sea bottom adjacent to the pipeline 9;

b. advancement means (26–29) supporting said frame and engaging the sea bottom;

c. guiding means (34, 35, 36) supported on said frame for guiding said frame exclusively in a lateral direction relative to the pipeline; and d. two rotating bucket wheels (15, 15', 16, 16') disposed side by side on either side of the pipeline (9)

parallel to the direction of advancement (p), the main planes of said bucket wheels enclosing an acute angle with each other and intersecting each other underneath the pipeline, said bucket wheels comprise an outer wheel (16) rotatably mounted on a stationary hub or stator (15), said wheel is further provided with a plurality of excavator buckets (58) having cutting edges (60) extending substantially in axial direction of the bucket wheel, the oppositely disposed sides of the excavator buckets are open, and each stator (15) being mounted on one end of a wheel arm (11) the opposite end thereof being pivotally connected to the frame, lifting means (17) are provided which on the one end engage on the frame and on the other end on said wheel arm (11), in order to bring the bucket wheel 15, 16 in the lowered or excavating position or the lifted position; and e. a dredge pump (23) having two suction tubes (22, 22') connected thereto, the end of which being pivotable in and out of the excavated trench (43), said pump further provided with two outlet tubes (24) which are connected to the pump (23), each end (25) of an outlet tube lying opposite a point of the path of movement of the excavator buckets (58), at the inner side of a bucket wheel (16, 16'), in order to empty the excavator buckets (58) of the contents therein with a water jet.

5. An apparatus according to claim 4, characterized in that the advancement means 26–29 comprise independently driven cylinders 26, 27 provided on either side of and parallel to the pipeline at the bottom side of the frame, which cylinders are provided at the outer circumference with spirally disposed fins 28, 29, the winding direction for the one cylinder 26 being opposite to that of the other cylinder 27 at equal pitch angle.

* * * * *

UNITED STATES PATENT AND TRADEMARK OFFICE

CERTIFICATE OF CORRECTION

PATENT NO. : 4,301,606

DATED : November 24, 1981

INVENTOR(S) : Paul Martin Hofmeester

It is certified that error appears in the above-identified patent and that said Letters Patent are hereby corrected as shown below:

On the title page,
[73] Assignee: "Netherlands Offshore Co., Delft, Netherlands"

Should read -- Netherlands Offshore Company (Nederlandse maatschappij voor werken buitengaats) B.V. --

Signed and Sealed this

*Fifteenth* Day of *June 1982*

[SEAL]

*Attest:*

GERALD J. MOSSINGHOFF

*Attesting Officer* *Commissioner of Patents and Trademarks*